United States Patent [19]

Devine

[11] Patent Number: 4,810,427

[45] Date of Patent: Mar. 7, 1989

[54] CARBURETORS

[75] Inventor: John Devine, Tralee, Ireland

[73] Assignee: 501 Tillotson Limited, Tralee, Ireland

[21] Appl. No.: 41,716

[22] Filed: Apr. 23, 1987

[30] Foreign Application Priority Data

May 1, 1986 [IE] Ireland ..... 1160/86

[51] Int. Cl.[4] ..... F02M 1/16

[52] U.S. Cl. ..... 261/35; 261/51; 261/DIG 8; 261/DIG. 68

[58] Field of Search ..... 261/DIG. 8, DIG. 68, 261/51, 35

[56] References Cited

U.S. PATENT DOCUMENTS

| | | | |
|---|---|---|---|
| 1,222,562 | 4/1917 | Rayfield | 261/DIG. 8 |
| 1,264,464 | 4/1918 | Weld | 261/DIG. 8 |
| 1,384,429 | 7/1921 | Cole | 261/DIG. 8 |
| 3,807,371 | 4/1974 | Nutten et al. | 261/DIG. 68 |
| 4,447,370 | 5/1984 | Kobayashi et al. | 261/DIG. 8 |
| 4,455,266 | 6/1984 | Gerhardy . | |
| 4,509,472 | 4/1985 | Slattery | 261/DIG. 68 |

FOREIGN PATENT DOCUMENTS

| | | | |
|---|---|---|---|
| 643419 | 4/1937 | Fed. Rep. of Germany . | |
| 1587198 | 3/1970 | France . | |
| 2333970 | 7/1977 | France . | |
| 2378952 | 8/1978 | France . | |
| 2509379 | 1/1983 | France . | |
| 55-5412 | 1/1980 | Japan | 261/DIG. 8 |
| 55-142951 | 11/1980 | Japan | 261/DIG. 8 |
| 60-209652 | 3/1986 | Japan . | |
| 1291993 | 10/1972 | United Kingdom . | |
| 1301269 | 12/1972 | United Kingdom . | |
| 1600424 | 10/1981 | United Kingdom . | |

*Primary Examiner*—Tim Miles

*Attorney, Agent, or Firm*—Harness, Dickey & Pierce

[57] ABSTRACT

A carburetor comprises a main body portion defining a venturi having an air intake side and an engine outlet side, a throttle shutter mounted within the venturi between the air intake side and the engine outlet side, a fuel chamber for supplying fuel into the venturi via a main discharge port and at least one idle discharge port, the main discharge port opening into the venturi on the air intake side of the throttle shutter, a choke feed passage extending from the fuel chamber to the venturi, the choke feed passage opening into the venturi on the opposite side of the throttle shutter to the main discharge port, and means for selectively opening and closing the choke feed passage. The fuel chamber comprises a metering diaphragm and the choke feed passage supplies pure fuel to the venturi, the carburetor being responsive to a lower pressure in the venturi on the engine outlet side of the throttle shutter than on the air intake side, when the throttle shutter is in a partially opened position and the choke feed passage is open, to cause fuel to be drawn from the fuel chamber primarily through the choke feed passage into the venturi on the engine outlet side of the throttle shutter.

1 Claim, 2 Drawing Sheets

CARBURETORS

This invention relates to carburetors, in particular but not exclusively to carburetors of the HU type used in chainsaws.

It has been the practice on chainsaws to which HU carburetors have been fitted, to fit a choke within the air filter. More recently, however, an HU carburetor has been introduced with a choke which consists essentially of a shutter blade which is selectively positionable in front of the carburetor venturi.

This, however, has its disadvantages. In particular, since the choke is operated from the main fuel discharge port (main jet), if the latter is incorrectly adjusted great difficulty may be encountered starting the engine due to the incorrect air/fuel ratio.

Accordingly, the present invention provides in a carburetor comprising a main body portion defining a venturi having an air intake side and an engine outlet side, a throttle shutter mounted within the venturi between the air intake side and the engine outlet side, a fuel chamber for supplying fuel into the venturi via a main discharge port and at least one idle discharge port, the main discharge port opening into the venturi on the air intake side of the throttle shutter, a choke feed passage extending from the fuel chamber to the venturi, the choke feed passage opening into the venturi on the opposite side of the throttle shutter to the main discharge port, and means for selectively opening and closing the choke feed passage, the improvement wherein the fuel chamber comprises a metering diaphragm and the choke feed passage is adapted to supply pure fuel to the venturi, the carburetor being responsive to a lower pressure in the venturi on the engine outlet side of the throttle shutter than on the air intake side, when the throttle shutter is in a partially opened position and the choke feed passage is open, to cause fuel to be drawn from the fuel chamber primarily through the choke feed passage into the venturi on the engine outlet side of the throttle shutter.

A carburetor having the features of the introductory part of the foregoing paragraph is described in Japanese patent application No. 53-75607. However, the choke feed passage described therein is of complex construction, and is applicable only to float type carburetors. By contrast, the present invention is concerned with and is only applicable to diaphragm type carburetors. Furthermore, in the Japanese patent application the choke feed passage supplies an adjustable mixture of air and fuel. In the present invention the choke feed passage supplies pure fuel to the venturi, the air being drawn in through the partially open throttle shutter. While supericially similar, the two systems are essentially quite different.

Preferably the choke feed passage comprises a hole formed in the main body portion of the carburetor, and the means for selectively closing and opening the choke feed hole comprises a bore formed in the main body portion which intersects the choke feed hole, and a plunger slidable in the bore between a first position wherein the plunger blocks the choke feed hole and a second position wherein the plunger does not block the choke feed hole.

The advantage of the invention as compared to the prior art is that a direct choke system is used, i.e. it is substantially independent of the setting of the main jet adjustment. Consequently, the engine is easier to prime and choking will always work irrespective of the main jet setting, provided that the orifice opening of the choke feed hole and the predetermined degree of opening of the throttle shutter are properly selected for the engine concerned.

Furthermore, when the engine is cranked and the correct air/fuel ratio reached, the engine will fire and continue to run in the choked condition. This contrasts with the prior art, where if the choke is left on, the carburetor is likely to flood. Accordingly, the saw may be left running on the choke to warm up the engine prior to use.

The invention also aids in eliminating the hot start problem. Instead of having the throttle shutter partially open when choking, it may be closed such that a large vacuum is transmitted through the metering chamber to suck out any fuel vapour which may have condensed in the carburetor.

Also, since the choke is independent of the main jet setting the engine will continue to run in the choked condition. If the engine does cut out when it is attempted to run it up to operating speed, by fully opening the throttle shutter and closing the choke feed hole, then this is indicative of an incorrect adjustment of the main jet.

An embodiment of the invention will now be described, by way of example, with reference to the accompanying drawings, in which.

Figure 1:
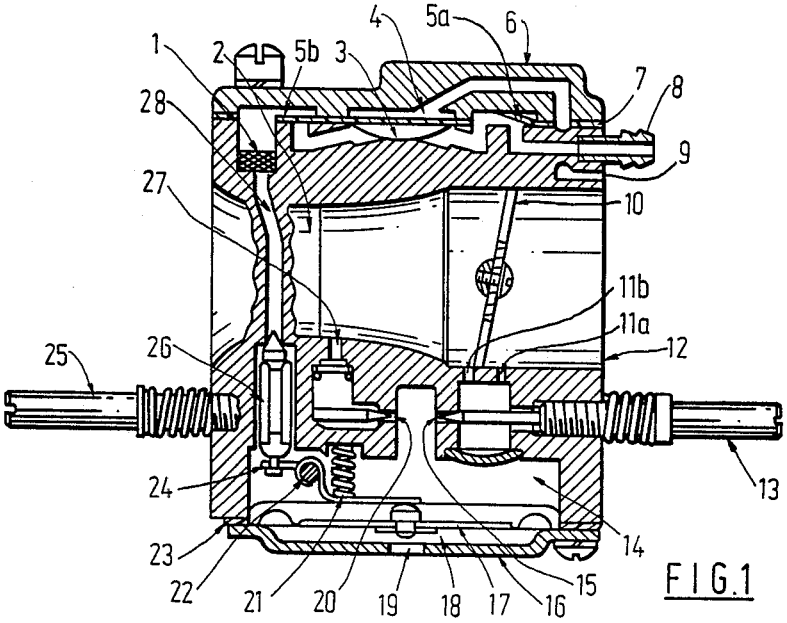
FIG. 1 is a cross-section through a conventional HU carburetor.

Referring now to the Drawings, FIG. 1 is a cross-sectional diagram of a conventional HU carburetor, and the parts indicated by the reference numerals in FIG. 1 are identified in the following list:

1. Filtering screen. 2. Venturi. 3. Fuel chamber 4. Pulse chamber. 5. Fuel pump diaphragm. 5A Pump diaphragm inlet valve. 5B Pump diaphragm outlet valve. 6. Fuel pump body. 7. Fuel pump gasket. 8. Fuel inlet. 9. Impulse channel. 10. Throttle shutter. 11A. Primary idle discharge port. 11B. Secondary idle discharge port. 12. Main carburetor body. 13. Idle fuel adjustment. 14. Metering chamber. 15.Idle fuel adjustment orifice. 16. Diaphragm cover. 17. Metering diaphragm. 18. Atmospheric chamber. 19. Atmospheric vent. 20. Main fuel adjustment orifice. 21. Inlet tension spring. 22. Fulcrum pin. 23. Diaphragm gasket. 24. Inlet control lever. 25. Main fuel adjustment. 26. Inlet needle. 27. Main nozzle discharge port. 28. Fuel inlet supply channel.

Since such carburetors are well known in the art, a full description of the operation thereof is not considered necessary. Briefly, however, in operation the metering diaphragm 17 is subject to engine vacuum on the metering chamber side 14 and to atmospheric pressure on the vented side 18. This differential pushes the metering diaphragm 17 towards the inlet control lever 24 which thereby pivots about the fulcrum pin 22 against the downward bias of the spring 21 to open the inlet needle 26. This allows fuel to enter the metering chamber 14 for delivery to the idle and main discharge ports 11 and respectively.

Fuel is caused to enter the metering chamber 14 by the fuel pump diaphragm 5. The pump diaphragm 5 is caused to move to and fro by pulsation from the engine sump, which acts on the pump diaphragm 5 through the impulse channel 9. This pulsing movement of the pump diaphragm 5 draws fuel into the fuel chamber 3 from which it passes through the inlet needle 26 into the metering chamber 14.

The choking operation of the above carburetor when starting a cold engine is as follows. A sliding shutter blade 30, FIG. 2 (not shown in FIG. 1), is placed in a closed position across the air intake side of the venturi 2, i.e. the left hand side as viewed in the drawings. The shutter blade 30 has only a small opening 29, and the blade 30 therefore substantially restricts the air flow through the venturi. At the same time, the butterfly-type throttle shutter 10 is placed in a cracked, or open, position as shown in FIG. 2.

As the engine is cranked, engine vacuum is transmitted through the engine outlet side of the venturi 2, i.e. the right hand side as viewed in the drawings, and through the idle discharge ports 11A and 11B as well as through the main discharge port 27, to the metering chamber 14. The creates a low pressure in the metering chamber 14. Atmospheric pressure in the chamber 18 on the opposite side of the diaphragm 17 will force the latter upwards, thereby opening the inlet needle 26 as described above and permitting fuel to flow into the metering chamber 14, and from there through both the idle and main orifices 15 and 20 respectively to the idle and main discharge ports 11A, 11B and 27 to the engine.

As mentioned above, this choking technique depends upon a correct adjustment of the main discharge port 27 as well as of the idle discharge ports 11A and 11B.

Figure 2:
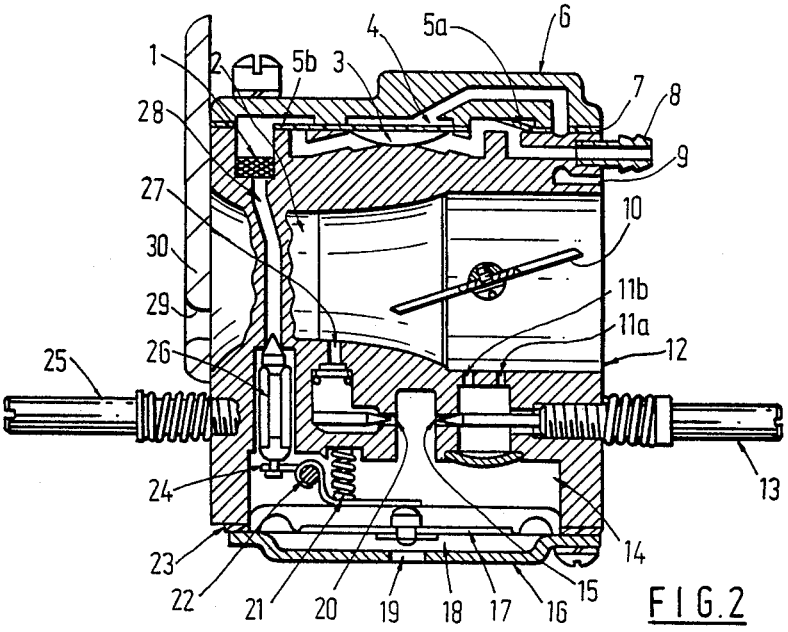
FIG. 2 shows the carburetor of FIG. 1 in a choked condition.
Figure 3:
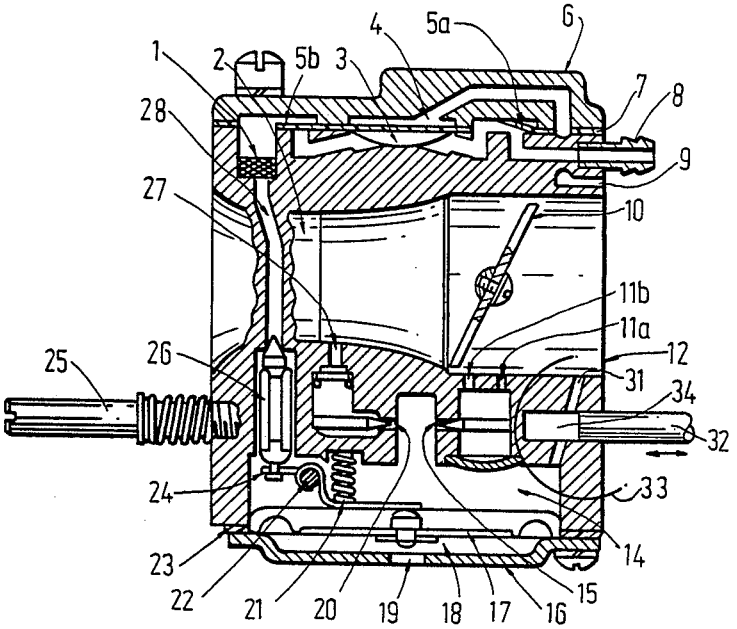
FIG. 3 is a similar cross-section of an embodiment of a carburetor according to the present invention in its choked condition.

FIG. 3 is a cross-section, similar to FIGS. 1 and 2, of an embodiment of an HU carburetor according to the present invention, having a different choking mechanism. In FIG. 3, parts which serve a like function to parts in FIGS. 1 and 2 have been given the same reference numerals.

In FIG. 3, the shutter blade 30 has been omitted, and a choke feed passage, in the form of a hole 31 in the carburetor body 12, has been provided which extends directly from the metering chamber 14 to the venturi 2. The choke feed hole opens into the venturi 2 on the opposite side of the throttle shutter 10 to the air intake side of the venturi 2. A plunger 32 is also provided which is a close sliding fit in a bore 34 which extends inwardly from the exterior of the main carburetor body 12 to intersect the choke feed hole 31. The plunger 32 is slidable between the position shown in FIG. 3, wherein the choke feed hole 31 is not blocked by the plunger, to a position wherein the plunger 32 is pushed more deeply into the bore 34 to abut the end wall of the bore and thereby block the choke feed hole 31. It is important that in normal use the plunger 32 should not be capable of complete withdrawal from the bore 34, and therefore suitable stop means (not shown) are provided.

To choke the engine, the throttle shutter 10 is partially but not fully cracked, and the plunger 32 is withdrawn to unblock the choke feed hole 31. This is the condition of the carburetor shown in FIG. 3. As the engine is cranked, engine vacuum is transmitted to the metering chamber 14 through the idle discharge ports 11A and 11B as well as through the choke feed hole 31, creating a low pressure on the fuel side 14 of the diaphragm 17. Atmospheric pressure in the chamber 18 forces the diaphragm 17 upwards to open the inlet needle 26 as heretofore described. This permits fuel to enter the metering chamber 14 and from there to enter the venturi 2, through the orifice 15 and idle discharge ports 11A and 11B as well as through the choke feed hole 31, for supply to the engine. When the engine has reached its operating temperature, the carburetor is operated in normal fashion by opening up the throttle shutter 10 and simultaneously pushing the plunger 32 into the bore 34 to block the choke feed hole 31, whereby the main discharge port 27 comes into operation.

It will be appreciated that in practice the throttle shutter setting mechanism will be coupled to the plunger 32 by a mechanism which automatically withdraws the plunger from the bore 34 to a sufficient extent to unblock the choke feed hole 31 when the carburetor is choked, and automatically pushes the plunger into the bore 34 to a sufficient extent to block the choke feed hole 31 when the throttle shutter is opened up to run the engine at operating speeds.

It will be readily observed that in the conventional choking mechanism shown in FIG. 2, the pressure differential which results in fuel flow into the engine when the engine is cranked lies between the vacuum in the venturi 2 and the atmospheric pressure outside the shutter blade 30 at the air intake side of the venturi. This causes fuel flow primarily from the main discharge port 27, and to a lesser extent from the idle discharge ports 11A and 11B.

By contrast, in the choking mechanism shown in FIG. 3, the pressure differential which causes fuel flow is moved downstream of the venturi 2, and now lies between the part of the venturi on the air intake side of the throttle shutter 10, which is at atmospheric pressure, and the part of the venturi which is downstream or on the engine outlet side of the throttle shutter 10, which is subject to engine vacuum. This differential results in fuel flow primarily from the choke feed hole 31, and to a lesser extent from the idle discharge ports 11A and 11B. Almost no fuel is fed into the venturi 2 from the main discharge port 27, since the region of the venturi 2 into which this port opens is substantially at atmospheric pressure.

Hence the basic difference between the two choking mechanisms lies in the omission of the shutter blade 30 in the embodiment of the invention and instead using the throttle shutter 10 to restrict the air flow, together with the closable choke feed hole 31 downstream of the throttle shutter as the primary source of fuel instead of the main discharge port 27.

It is to be understood that the cross-sectional portion of the carburetor indicated within the semicircle 33 of FIG. 3 is taken on a different vertical plane to the rest of the carburetor shown in that Figure. Thus the idle fuel adjustment 13 is not shown in FIG. 3 although it is still present in this construction of the carburetor.

It is to be understood that the diameter of the orifice of the choke feed hole 31 and the degree of opening of the throttle shutter 10 in the choke condition must be properly selected such that a cold engine with a dry carburetor will preferably start in no more that 4 to 6 pulls and will remain running with the choke on at an r.p.m. below chain engagement. These parameters are largely dependent on the manifold vacuum available when cranking the engine, which will vary from engine to engine in dependence upon such factors as piston displacement volume, volume of crank case and timing of the inlet port.

These parameters can be readily derived by experiment for any particular engine. However, as an example only, the following settings have been found suitable for the Stihl 024 and Dolmar 110 engines:

STIHL 024

Carburetor type: HU type

Choke feed hole orifice size: 0.025 inches. Throttle shutter speed screw setting: Between 4 and 5 turns open.

DOLMAR 110

Carburetor type: HU type

Choke feed hole orifice size: 0.03 inches.

Throttle shutter speed screw setting: Between 4 and 5 turns open.

I claim:

1. A diaphragm carburetor comprising a main body portion defining a venturi having an air intake side and an engine outlet side, a throttle shutter mounted within the venturi between the air intake side and the engine outlet side, a diaphragm-controlled fuel chamber for supplying fuel into the venturi via a main discharge port on the air intake side of the throttle shutter, a diaphragm-operated pump for supplying fuel to the fuel chamber, a choke feed passage extending from the fuel chamber to the venturi and adapted to supply pure fuel into the venturi on the opposite side of the throttle shutter to the main discharge port, and means for selectively opening and closing the choke feed passage, said selective opening and closing means comprised of a bore in said main body associated with said choke feed passage and a plunger slidable in said bore from a first position to a second position wherein in said first position said plunger unblocks said choke feed passage and is maintained in said first position by friction between said plunger and said bore and in said second position said plunger blocks said choke feed passage and is maintained in said second position by friction between said plunger and said bore, the carburetor being absent a choke shutter and the throttle shutter being the sole shutter for controlling air flow through the carburetor, the carburetor being responsive to a lower pressure in the venturi on the engine outlet side of the throttle shutter than on the air intake side, when the throttle shutter is in a partially opened position and the choke feed passage is open, to cause fuel to be drawn from the fuel chamber primarily through the choke feed passage into the venturi on the engine outlet side of the throttle shutter, wherein the throttle shutter is coupled to the plunger such that the plunger is automatically withdrawn from the bore to said first position to unblock the choke feed hole when the carburetor is choked, and automatically pushed into the bore to said second position to block the choke feed hole when the throttle shutter is opened up to run the engine at operating speeds.

* * * * *